US011504566B2

(12) United States Patent
Fujii

(10) Patent No.: US 11,504,566 B2
(45) Date of Patent: Nov. 22, 2022

(54) MODULAR HANDHELD WEIGHT TRAINING APPARATUS AND CLOSURE SYSTEM

(71) Applicant: Scott Kikuo Fujii, Canoga Park, CA (US)

(72) Inventor: Scott Kikuo Fujii, Canoga Park, CA (US)

( * ) Notice: Subject to any disclaimer, the term of this patent is extended or adjusted under 35 U.S.C. 154(b) by 349 days.

(21) Appl. No.: 16/739,100

(22) Filed: Jan. 9, 2020

(65) Prior Publication Data

US 2020/0215375 A1 Jul. 9, 2020

Related U.S. Application Data

(60) Provisional application No. 62/790,004, filed on Jan. 9, 2019.

(51) Int. Cl.
*A63B 21/06* (2006.01)
*A63B 21/00* (2006.01)

(52) U.S. Cl.
CPC ..... *A63B 21/0603* (2013.01); *A63B 21/4035* (2015.10); *A63B 2209/10* (2013.01); *A63B 2210/50* (2013.01)

(58) Field of Classification Search
CPC ..... A63B 21/0603; A63B 21/072; A63B 21/0724; A63B 21/075; A63B 21/4035; A63B 2209/10; A63B 2210/50
See application file for complete search history.

(56) References Cited

U.S. PATENT DOCUMENTS

| | | | | |
|---|---|---|---|---|
| 2,210,351 | A * | 8/1940 | Westendorf | A45C 3/00 383/18 |
| 4,261,448 | A * | 4/1981 | Myers | A45C 13/26 383/18 |
| 4,951,940 | A | 8/1990 | Vitello | |
| 5,242,348 | A | 9/1993 | Bates | |
| 6,149,555 | A | 11/2000 | Kinback | |
| 7,381,157 | B2 | 6/2008 | Blateri | |
| 8,109,863 | B2 | 2/2012 | Gilberti | |
| 8,276,351 | B1 * | 10/2012 | Henkin | A63B 21/0603 53/469 |
| 8,622,877 | B2 | 1/2014 | Raines | |
| 8,911,334 | B1 | 12/2014 | Cotter | |
| 9,320,938 | B1 * | 4/2016 | Belmore | B65D 81/18 |
| 10,149,997 | B1 * | 12/2018 | Henniger | A63B 21/0603 |
| 10,343,009 | B2 * | 7/2019 | Peyton | A63B 21/0602 |
| 10,981,030 | B2 * | 4/2021 | Henniger | A63B 21/0603 |
| 2005/0187075 | A1 | 8/2005 | Bellamy | |
| 2007/0049469 | A1 * | 3/2007 | Brown | A63B 21/0603 482/93 |

(Continued)

*Primary Examiner* — Joshua Lee
(74) *Attorney, Agent, or Firm* — Narek Zohrabyan; Phil IP Law Inc.

(57) ABSTRACT

A modular weight training bag system, made up of a main bag constructed of heavy pliable fabric with a zipper-less closure, an inner lining that holds a granular material which adds weight and volume to the main bag, and also has a uniquely designed closure, using various size pouches to increase weight, an add-on weight attachments installed on the main bag for the purpose of quickly increasing the weight of the bag, a capsule sleeve for securing two main bags together, and a soft shell constructed to cover the main bag or capsule sleeve.

15 Claims, 14 Drawing Sheets

(56) References Cited

U.S. PATENT DOCUMENTS

| | | | | |
|---|---|---|---|---|
| 2010/0022361 | A1* | 1/2010 | Raines | A63B 21/0603 141/10 |
| 2011/0287904 | A1 | 11/2011 | Morris | |
| 2012/0058863 | A1 | 3/2012 | Brizard et al. | |
| 2012/0149536 | A1 | 6/2012 | Trimble et al. | |
| 2012/0322627 | A1 | 12/2012 | Emerson | |
| 2013/0123084 | A1 | 5/2013 | Miklósi et al. | |
| 2013/0157815 | A1 | 6/2013 | Reynolds et al. | |
| 2015/0182777 | A1 | 7/2015 | Rarity, IV | |
| 2016/0129292 | A1* | 5/2016 | Stroup | A63B 21/4035 434/247 |
| 2018/0333603 | A1* | 11/2018 | Peyton | A63B 21/0603 |
| 2019/0175978 | A1 | 6/2019 | Raines et al. | |
| 2019/0269956 | A1* | 9/2019 | Henniger | A63B 21/0603 |
| 2019/0351277 | A1* | 11/2019 | Bassoo | A63B 21/065 |
| 2021/0113880 | A1* | 4/2021 | Bassoo | A63B 23/047 |
| 2021/0346777 | A1* | 11/2021 | Coughlan | A63B 21/072 |
| 2022/0032109 | A1* | 2/2022 | Henniger | A63B 21/0603 |

* cited by examiner 504
514
524
523
iv
518
502 v
515
512
525
100 vi viii
vii

MODULAR HANDHELD WEIGHT TRAINING APPARATUS AND CLOSURE SYSTEM

CROSS-REFERENCE TO RELATED APPLICATION

This application claims the benefit of and priority to U.S. Provisional Application Ser. No. 62/790,004 filed on Jan. 9, 2019 which is incorporated herein in its entirety by reference.

BACKGROUND OF INVENTION

This invention relates to modular exercise weights that can be modified to increase or decrease its weight, while providing safety for the user and insuring that the contents of the weights do not spill out.

Frequent users of heavy weights for resistance exercises run into a multitude of problems in a gym setting. One such problem deals with the inflexibility of the weight apparatus that may be designed for a very specific exercise. Usually, the premade exercise weights are not compatible with use for other exercise routines. This severely limits the user's ability to use one exercise equipment for working on different muscle groups or incorporating different exercise routines. For new set of exercises, new types of equipment are necessary to accomplish the goal. This increases cost and invariably the user ends up wasting space to store specialized equipment designed for limited types of use.

Moreover, other limitations exist with specialized equipment. Namely, they are usually made as a static structure that do not allow the user to vary the weights within, or if they do allow for that expansion, the profile of the exercise weights change. For example, a typical kettle bell has a long handle that connects to a fixed weight. Using a fixed weight kettle bell limits the user's ability to increase the intensity of the exercise routine such that a new kettle bell is needed for progression of the exercise. Thus, the user has no choice but to upgrade the fixed weight to yet another fixed weight kettle bell. Once the user graduates from using that weight, he or she has no other choice but to go on to the next, higher weight kettle bell. It is worthy to note that in such a scenario, the kettle bell's increase in weight requires the handle to be elongated or made to be bigger to account for the increased weight. This structural change also affects the way a kettle bell exercise is performed. The elongated handle requires maneuvering the hands and body in a different way in order to maintain balance and posture while making sure the user does not hurt themselves or other people around them. Thus, the profile of the exercise equipment changes as the weight is increased.

Furthermore, increasing the capacity of the fixed rigid weights also increases the chance that the exercise object can impact the user's body as well as areas that were not intended to come into contact with the fixed rigid weights. For example, if one uses a kettle bell, going from a rest stance to an engagement stance can cause the bulk of the kettle ball to twist unto and rotate around the user's hand and arm. This brief contact can cause some damage or at least discomfort to the user. Over time, a rash may appear when the user constantly initiates this routine exercise. Worse yet, the limited maneuverability of the handle can cause the wrist to collapse on itself causing the kettle bell to drop on the floor or unto the user's limbs.

Yet another issue prevalent with fixed weight exercises is the danger of dropping them unto the floor. Because these types of weights are rigid in nature, dropping them on the floor, accidentally or intentionally, makes a lot of noise. Besides the noise factor, the weights bounce on the floor causing damage over time. This is why gyms install layers upon layers of foam or rubber mats in order to minimize the impact of typical fixed weights. These impacts notoriously create excess noise, vibrations in the building structure and show permanent depressions unto the floor. Assuming adequate cushioning is employed in a gym, there is still a risk that the user will drop the weight unto someone's limbs. Because of this eventuality, a certain population of gym patrons may stay away from using fixed weights such as kettle bells or dumb bells. The crushing impact a typical fixed weight apparatus can have on someone's bones and muscles psychologically causes some patrons to not engage with those weights for fear of getting hurt.

The same problems also exist when using dumb bells for various exercises such as for bicep curls. The user has to progressively increase the weights by adding metal plates and/or using heavier dumb bells. Usually, adding metal plates or using higher fixed-weight dumbbells also changes the maneuverability of the weight itself. The bulky weights cause the arm box area to be constricted so the user has less room to flex his arm and hand. Therefore, the whole exercise profile changes making the exercise routine less uniform from one weighted system to another.

These, among others, are the areas of concern that this invention aims to solve. Therefore, novel exercise weights have been envisioned here to allow for the apparatus to maintain a low-profile handle, allow the user to increase weights, allow the user to integrate another modular weight while keeping a low-profile structure, allow the user to manipulate the weights without risk of injuring himself, other people or causing damage when dropped onto the floor, and ultimately securing the contents of the weights and making it spill-proof.

The invention of this application also has ancillary components that further improve the usability of the exercise weight. One such component is incorporation of a weight sleeve for adding incremental weights on the fly without changing the contents of the bag. Another aspect is the ability to customize the physical appearance of the bag using a shell which can display the weight of the bag, color and insignia of the gym. The conjoining of the modular weights can be accomplished by using a sleeve capsule that may further show the weight contents of the bags and/or insignia of the gym. A transparent window may also be incorporated unto the sleeve capsule or the shell, showing the weight contents of the bag and/or the gym insignia.

Various technologies exist in the market that purport to solve the problems addressed above; however, they all fall short of what is envisioned here. One such example is discussed in United States Published Patent Application No. US 2012/0058863A1 filed by Brizard. In the Brizard publication, a pouch is shown to have a unitary body that can be filled with granular substances such as pellets or beads. The pouch, once filled with these granular substances, can be closed with use of a hook and loop fasteners, placed both inside the funnel as well as outside of the funnel. The combination of these hook and loop fasteners are provided to secure the contents in place and seal it from the environment. However, Brizard does not show inserting a mix of granular medium along with metal beads. Moreover, Brizard does not show the ability to combine it with other weights in a conjoined fashion. Additionally, the hook and fastener mechanism employed is not adequate to make it completely spill-proof. Furthermore, Brizard does not talk about having an external wrap around sand filled pouch to be used to add incremental weights. Finally, Brizard does not describe the particular internal funnel mechanism that can have a hook and loop fastening system that stays shut due to the medium's ability to compress the two halves together as envisioned by this application.

In another reference, such as in U.S. Pat. No. 8,109,863B2, filed by Gilberti, shows the internal and external seals described such that they can be combined to provide a seal from the elements. However, the particular hook and loop mechanism envisioned by this application is absent from Gilberti, which extends inside of the weight pouch and is sealed shut by the fact of the weights enclosing around the closed hook and loop fastener.

In another publication, filed by Henkin under U.S. Pat. No. 8,276,351B1, discloses a weight training exercise apparatus with a particular sealant system. The sealant system uses both stitching and hook and loop fasteners to contain the contents of the apparatus. In particular, the stitched sections can be inverted to put on reverse pressure by the medium to further secure the contents. The hook and loop fasteners are also used to secure the contents at another end of the pouch in a more traditional sense unlike the specific mechanism envisioned by this application. In this application, the hook and loop fastener use internal pressure supplied by the granular medium and/or beads to provide a complete seal. Combined with the outer double layered hook and loop fasteners of the invention of this application makes the pouch impermeable.

All of these various technologies in the field are inadequate in solving the issues identified above. Some of these technologies attempt to increase the weight by using granular weighted materials. However, this simple addition fails to address the core problem existing in such applications because simply the size and shape of the weight increase makes them a specialty piece of equipment that makes it difficult to use them during traditional strength training exercises. Other technologies aim to fill the need for a varied stimulus during single arm movements. However, this integration exacerbates the problem because all that results from it is that the size and shape of the weights vary across different weighted weights. This invariably affects the way some exercises can be done as the functional movement is impacted by the varied sizes. The heavier and bulkier the weights get, the different an exercise movement has to be engaged in order to properly achieve results. Thus, one exercise routine can become a set of exercise routines just to target a certain muscle group. This is because purely adding weight changes the profile of the exercise weights. Causing the user to retrain the way they perform the exercise.

SUMMARY OF INVENTION

According to an embodiment of the present invention, the modular weight system is designed to allow for increase in the intensity of the different movements for improving one's strength and conditioning while keeping a uniform profile as the weight increases either incrementally or in significant proportions.

The core concept of this invention is that it employs a main bag that is constructed from a heavy-duty fabric which can house an inner lining. The main bag can be made of pliable, yet tough materials, to withstand multiple uses and falls unto the floor. Such materials can consist of vinyl, canvas, rubber, nylon or a compatible flexible substance. The purpose of the main bag is to support and encapsulate the inner lining, to provide a support system for the single handle, to allow a means for an outer weight to attach unto the bag, to allow for yet another main bag to conjoin it using a sleeve. The main bag can have a series of overlapping hook and loop fasteners to allow the user to close the contents of the bag shut as well as to tighten lose sections of the main bag itself. By strategically placing the hook and loop fasteners in various sections of the main bag, the user can close shut one layer of the main bag's opening on top of another layer of hook and loop fastener sectioned layer so that the contents of the bag become semi-rigid and impermeable while maintaining a uniform profile of the weighted bag. Series of these hook and loops fasteners allow for securing of the weight inside the main bag as discussed below.

The main bag houses the inner lining which is used to hold the contents of the weight. The inner lining can be made of materials similar to the material used to construct the main bag. The inner lining also has hook and loop fasteners which allow the user to secure the contents of the inner lining. There may be hook and loop fastening sections that extend inside of the inner lining as well as outer hook and loop fastening sections to completely seal off the contents. In one embodiment, an inner set of "lips" extends well into the inner lining. These "lip" sections have at their ends matching hook and loop fasteners that provide a closing mechanism. When the contents of the inner liner are filled, these sections close and are further reinforced by the weight of the granular contents of the inner lining. The more pressure that is applied from the inside of the inner lining, the harder these fasteners keep the closure shut. Moreover, the further impact the weight takes, say for example by being dropped many times, the more the hook and loop fastener secures the contents. The inner lining also has the inner set of lips that extend out of the inner lining, creating a funnel like opening. At the funnel's opening, there exists another set of hook and loop fasteners sewn onto it. These hook and loop fasteners are used to further roll the funnel shut and fastened onto the body of the inner lining. In one embodiment, the external inner lining has a set of hook and loop fasteners. Furthermore, the funnel's opening can have a wide shape, a narrow shape or any variation of sizing.

The inner lining is strong enough to support the contents whether it is entirely made of sand, rice or some other type of granular medium, solid metallic bars, metal shavings, metal beads or ball bearings. The inner lining can be filled in various proportions to accommodate the needs of the user. In one scenario, half of the inner lining can be filled with a granular medium and the second half can be filled with metal beads. It is envisioned that the core of the inner lining will contain the more dense and heavier material where as the surroundings will be mostly composed of the granular medium. This is to allow maximum flexibility and pliability of the modular weights especially when the user drops it down onto the floor or onto someone's limb. Because the denser and heavier metal beads can increase the amount of force it applies onto a floor or someone's limb, it is imperative that the outer core is filled mostly of the granular medium. This is because granular medium creeps more and absorbs energy more at each grain of the granular medium than a more heavier and denser material.

Moreover, it is envisioned that the denser and heavier material can be packaged in packets and inserted in the core of the inner lining so that the contents do not slowly move towards the radial part of the inner lining. If the packet is inserted in the middle of the inner lining and then the packet is surrounded in all "six sides" or up to 360 degrees, on each plane, with the granular medium, the chances that the whole packet will travel outside of the center region are minimized.

By allowing the user to add a heavier and denser weight packet inside of the inner liner, he can increase the weight of the modular weight bag without affecting the overall shape, size and profile of the weight bag. Thus, this aids the user in keeping the exercise routine uniform as the weight increases incrementally or in higher proportions.

After the inner lining is filled with the desired content, the hook and loop fasteners are secured, and the inner lining is inserted into the main bag. In another embodiment, the inner lining is placed alongside the packaged packet inside of the main bag. It can be arranged such that the packaged packet is placed above the inner lining so when the main bag is dropped onto the floor, the granular mediums inside the inner lining absorb most of the energy.

Once the inner lining and packaged packet combination is finalized, they are stuffed into the main bag. The main bag is then tightly fastened and adjusted by the sections of the hook and loop fasteners. As the contents are secured in place, the single handle located above the modular weight allows the user to lift the weight and conduct various exercise routines. The single handle is made of a tubular device such as a section of a hose, a section of a PVC (polyvinyl chloride) pipe, ABS (acrylonitrile butadiene styrene) plastic, thermoplastic, plastic, aluminum, steel, wood, a similar pliable tubing material or a similar material that the main bag is made of. The single handle is connected to the main bag in such a way as to maintain a low profile. Moreover, as the weight of the main bag increases, the low-profile aspect of the handle still remains unchanged due to the main bag's outer construction that incorporates the single handle. Double stitching of the material which is covered by the tubular handle allows the modular weight to maintain its integrity regardless of how much weight is inserted into the inner lining.

The modular weights have an elongated profile with a central wraparound section that can be used to add incremental weights. The modular weights can include add-on weights or a weight sleeve which are pouches filled with sand or a similar type of granular medium. The add-on weights allow a user to increase the weights on a fly and with set incremental values. For example, a user can increase the weight by 2.51 bs without changing the contents of the modular weight. This may be desirable for certain exercises and by certain users who do not want to make a substantial jump in the weight amount, going from one set of weights to the other. These add-on weights wrap around the circumference of the modular weights and terminate at two points of contacts using two sets of hook and loop fasteners. One set overlaps from the underside of the add-on weight and another set overlaps from the surface side of the add-on weights as they are fastened on one another. Therefore, add-on weights are somewhat attached loosely unto the main bag. Movement is restricted tangentially to the radius of the main bag as the add-on weight somewhat slides in the underside of the single handle. The add-on weight can have a patch section incorporated upon it with a hook or loop material to allow the user to add the insignia of the gym and/or weight information of the add-on weight. Moreover, a transparent window section can be incorporated onto the add-on weight's material such that an insignia or weight information placed on the main bag can be displayed to the user. The add-on weight then can be stored away by rolling it unto itself and using the hook and loop patches to keep it firmly secured. Finally, the add-on weight material can be made of the same material that the main bag is made of.

The main bag can be combined with another main bag in a conjoined fashion to significantly increase the weight of the modular weights. This is achieved with use of a sleeve capsule that is made of the same material as the main bag. The sleeve capsule has a wider profile allowing two main bags to be placed side by side in the same plane and inside the sleeve capsule. The sleeve capsule has a set of extending belts at the top part of the sleeve capsule where the main bags are inserted from. The extending belts have a set of hook and loop fasteners in various configurations which allows each belt to go through a looped section on one side of the sleeve capsule and wrap around to the other end that is terminated onto the sleeve capsule. Then the inner side of the extending belt fastens onto the inner side of the extending belt with the hook and loop fastener. After that, at the terminating end of the extending belt a set of flaps wrap over the outer side of the extending belt where another set of hook and loop fasteners closes the extending belt completely shut. On the opposite end of the sleeve capsule, the other extending belt is looped under and secured using set of hook and loop fasteners and the flap, securing the two main bags within the sleeve capsule. By taking in the slack of the extending belts and closing the hook and loop fasteners, the two main bags inside the sleeve capsule are tightly packed into place. At this point, the individual handles of each bag are now located near one another and in the midsection of the sleeve capsule. An extending side of the sleeve capsule runs underneath both handles and overlaps onto the other end of the sleeve capsule in the midsection. This extending side is secured in place using another set of hook and loop fasteners where the extending side overlaps with the other end of the sleeve capsule in the midsection. A wrap around belt is also stitched unto the extending side of the sleeve capsule. This wrap around belt covers both handles of the main bags and is secured in place with a set of hook and loop fasteners, further limiting movement of the main bags. On the opposite side of the sleeve capsule, directly opposing the extending side of the sleeve capsule, another single handle is installed with the same low-profile structure. The single handle is thus used to perform similar type of exercises without changing the mechanics of the exercise. Due to this low-profile design, the same structure and maneuvering can be used but with significant increase of weights. The sleeve capsule can later be unwrapped, and the main bags emptied from it. The sleeve capsule can also have a set of hook or loop patches which allows the user to attach insignia or indicate the weight information of the conjoined modular weights. Moreover, a hook or loop patch sections can be used to roll up the sleeve capsule unto itself and compress it down for storage.

To further pad the conjoined modular weights, a shell can be used which completely covers the conjoined modular weights, save a section of the shell which has a cutout allowing the single handle to stick out. The shell can also have flaps with hook and loop fasteners to ensure that the contents are locked into place. Furthermore, the shell can have a transparent section and/or another hook or loop patch section allowing for display of the gym insignia or the weight information of the contents. This shell can be made of a neoprene material, a rubber or foam material or any type of flexible and soft material known in the field.

This disclosure will now provide a more detailed and specific description that will refer to the accompanying drawings. The drawings and specific descriptions of the drawings, as well as any specific or alternative embodiments discussed, are intended to be read in conjunction with the entirety of this disclosure. The A modular handheld strength training bag system may, however, be embodied in many different forms and should not be construed as being limited to the embodiments set forth herein; rather, these embodiments are provided by way of illustration only and so that this disclosure will be thorough, complete and fully convey understanding to those skilled in the art.

BRIEF DESCRIPTION OF THE DRAWINGS

The invention will be further described by reference to the accompanying drawings wherein:

FIG. 3 is a top-down view of the main bag exposing the compartment where the weights are stored in.

FIG. 4 is a top-down view of the main bag being closed shut when the compartment has been filled in.

DETAILED DESCRIPTION

Figure 1:
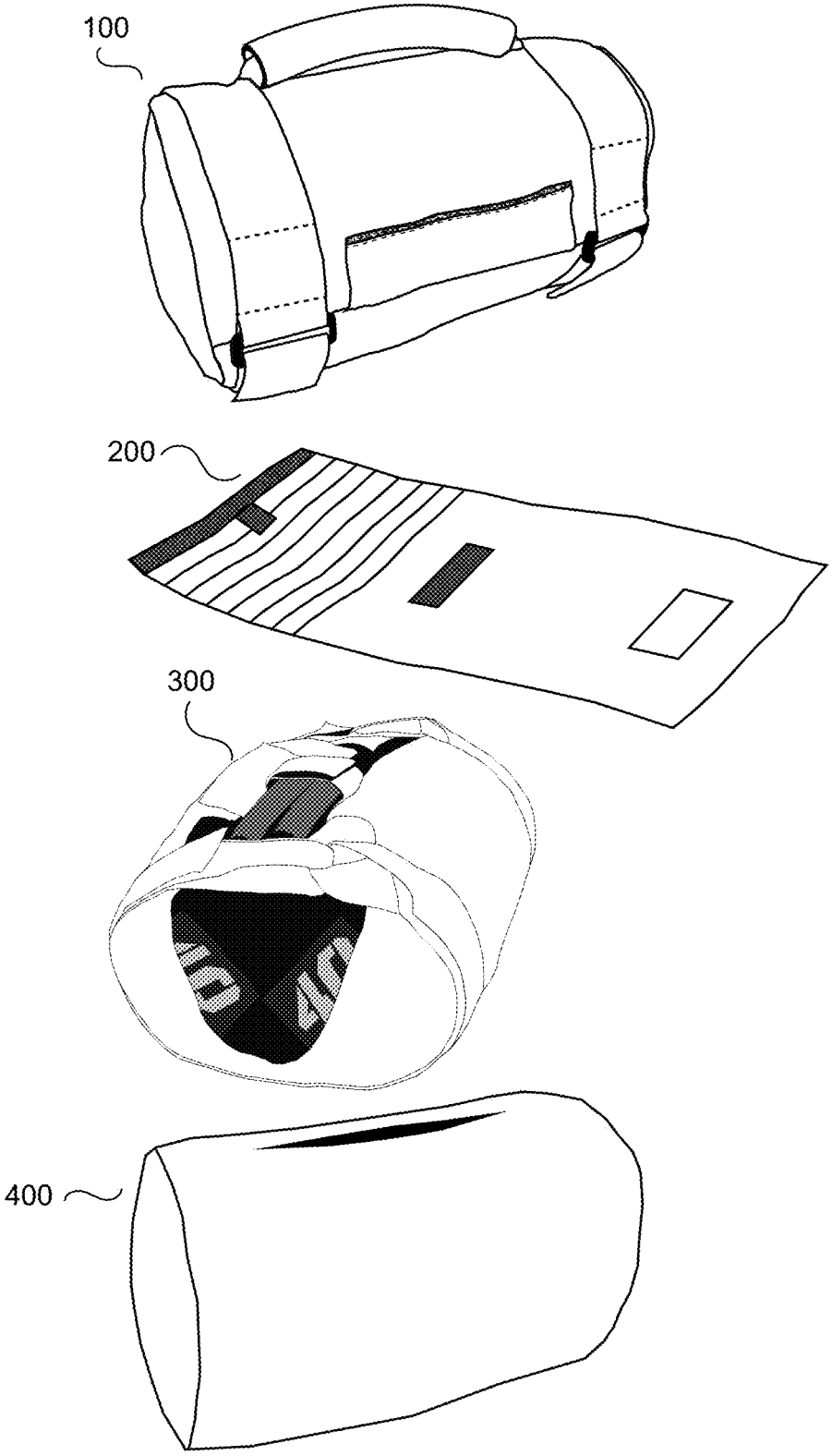
FIG. 1 is a component view of the invention described showing the modular weight, the add-on weight, the sleeve capsule with two modular weights stored inside and the shell.

The present invention, as shown in FIG. 1, illustrates one of the modular weights 100, the add-on weight 200, the sleeve capsule 300 and the shell 400.

Figure 2:
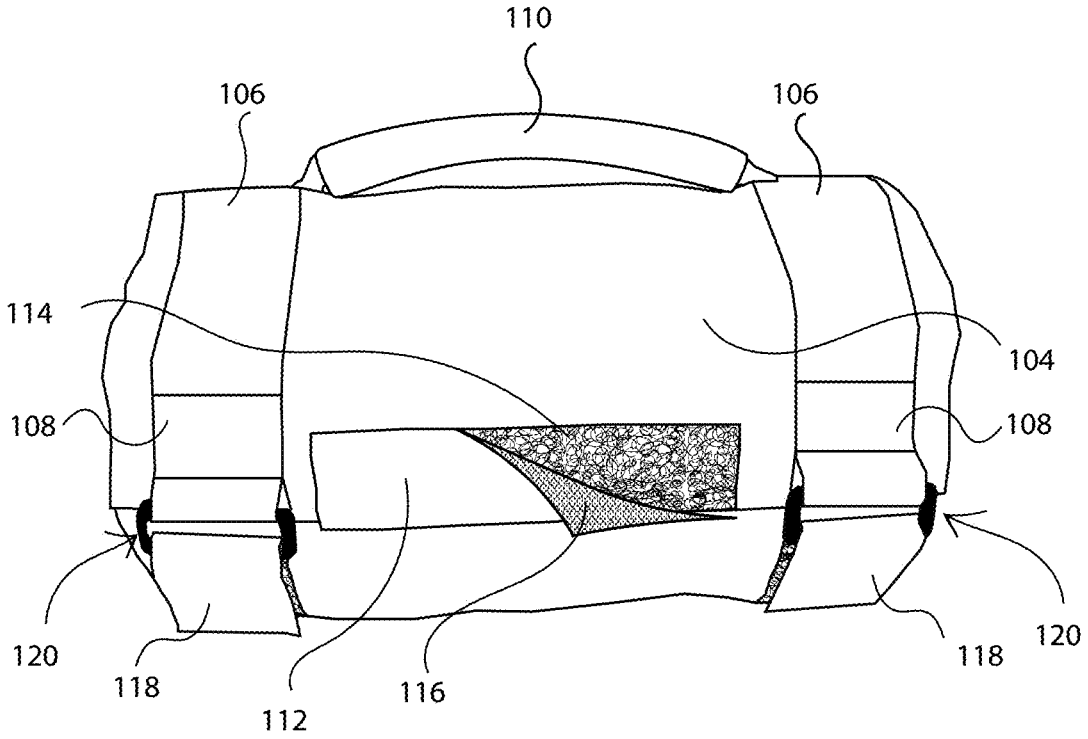
FIG. 2 is a front view of the modular weight illustrating the individual parts thereon.

In one embodiment, the modular handheld weight training apparatus and closure system of this application shows the various components in FIG. 2. The single handle 110 of each modular weight 100 is shown in the midsection. The single handle 110 is made from a rigid tubular substance that is inserted over a thicker material or fabric that the rest of the main bag 104 is made of The single handle 110 can be made of a tubular plastic device or any compatible rigid material such as PVC (polyvinyl chloride), ABS (acrylonitrile butadiene styrene) plastic, thermoplastic, plastic, aluminum, steel, wood, a similar pliable tubing material or a similar material that the main bag is made of. The purpose of the single handle 110 is to allow the user to lift the modular weight 100. The single handle 110 is installed in such a way as to keep a lower profile which enables the user to maintain a uniform form in performing their desired exercise. The single handle 110 may have some inherent flexibility built in as the contents of the modular weight 100 are increased by weight. However, the general structure of the modular weight 100 and the single handle 110 do not change regardless of how much weight is added and what type of exercise is conducted. The single handle 110 remains in place and is secured by robust stitching in and around the single handle 110 where the modular weight 100 has reinforcement bands 106 sewn unto the main bag 104. It is contemplated that the embodiments of the modular weight 100 have single or double stitching in order to provide a secure construction.

The modular weight 100 has two reinforcement bands 106 wrapped circumferentially around the modular weight 100, at each end. The reinforcement bands 106 can be made of the same material that the main bag 104 is made of Those materials are heavy-duty but also flexible. Examples of them are: vinyl, nylon, canvas, rubber, nylon or a compatible flexible substance. The two reinforcement bands 106 are then stitched unto the main bag 104. The reinforcement bands 106 have one end which terminates on itself at section 108 which invariably creates a section where a ring 120 can be installed. These rings 120 can be "D-rings" or a square fitted ring which are used as a guide for securing the flap ends 118 of the reinforcement bands 106. The flap ends 118 have a hook and loop type fasteners sewn on the inside part of the flap ends 118 allowing them to fold over and provide closure. The flap ends 118 are inserted through the rings 120, and then folded over for the hook and loop fastener to close the system. That secures the contents of the main bag 104. The rings 120 can be made of a plastic material, a composite material or even a metallic material. Furthermore, the closure mechanisms used can be something other than a traditional hook and loop fastener such as a snap in fastener, button style or any type of system known in the art.

The main bag 104 has an extension flap 112 sewn unto it that extends over the other end of the main bag 104 material. The extension flap 112 overlaps about an inch or two in order to provide further closure in the midsection. Underneath the extension flap 112 a section of a hook 116 is sewn onto it which meets the loop 114 section sewn onto the main bag 104. The hook 116 and loop 114 sections come together to provide closure at the midsection seem.

Figure 3:
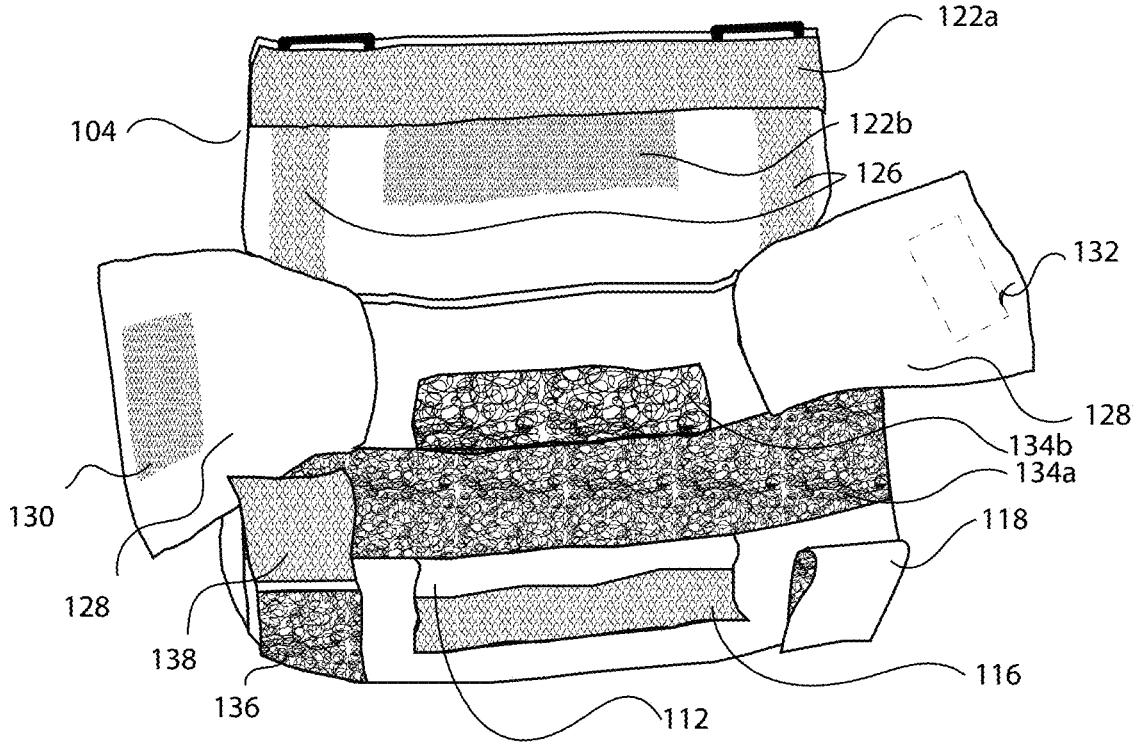

In FIG. 3, an embodiment of this invention is shown with the main bag 104 exposing the inside compartment. The extension flap 112 shows the underside where the hook 116 section is incorporated on the fabric. Moreover, another hook section 138 and loop section 136 is shown to be incorporated on the inside section of the flap ends 118. The main bag 104 also shows the inside flaps 128 extending from each side of the main bag 104. The inside flaps 128 are used to further secure the contents of the main bag 104 by overlapping on each section of the inside flaps 128 and fastening them together using another set of hook 130 and loop 132 sections (on the opposite side) incorporated on the inside flaps 128. The midsection of the main bag 104 also incorporates a running hook 122*a* and a running loop 134*a* along with an extended hook 122*b* and extended loop 134*b* to provide for further securing of the one end of the main bag 104 unto itself. On the radial sides of the main bag 104, there exist another set of hooks 126 and loops (not pictured) sections so that when the main bag 104 is closed onto itself, all three sides (midsection, both radial ends) close tightly with a hook and loop fastener. The series of hook and loop fasteners are intended to really dial in and tightly compress the weight inside the main bag 104 which guarantees that the contents of the main bag 104 do not shift around or eject out from a rigorous exercise routine. Because it is envisioned that the main bag 104 can take up to 40 lbs of load, the multiple points of contact are needed by the combination of the hook and loop fasteners in order to allow free movement of the modular weight 100 while keeping the contents secure.

Figure 4:
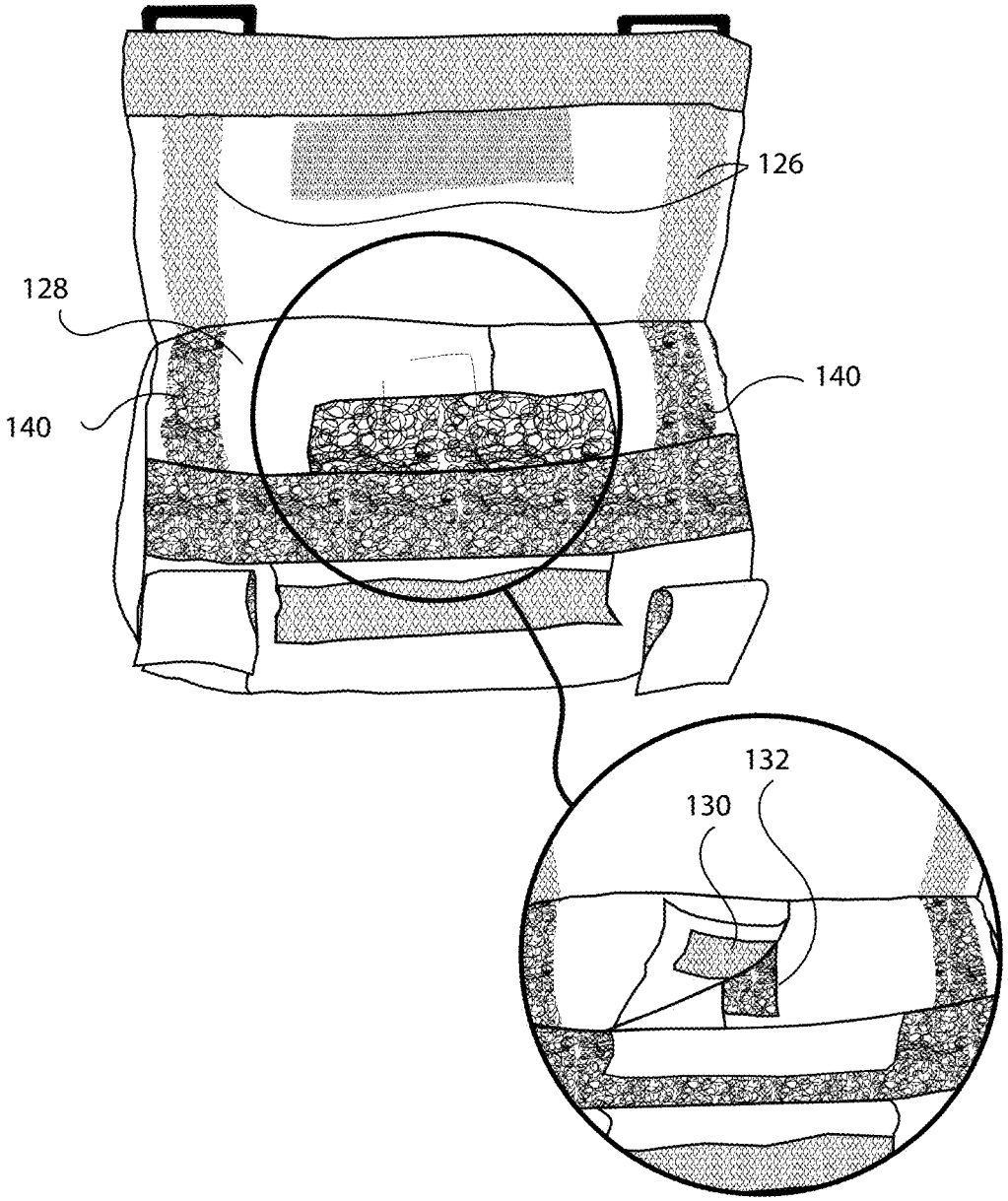

In FIG. 4, the modular weight 100 is shown where the inside flaps 128 are folded over on one another to secure the contents of the main bag 104. The portion where the hook 130 and loop 132 sections fasten together is magnified for illustrative purposes. Furthermore, radially placed hooks 126 and loops 140 are now exposed as the inside flaps 128 are folded over.

Figure 5:
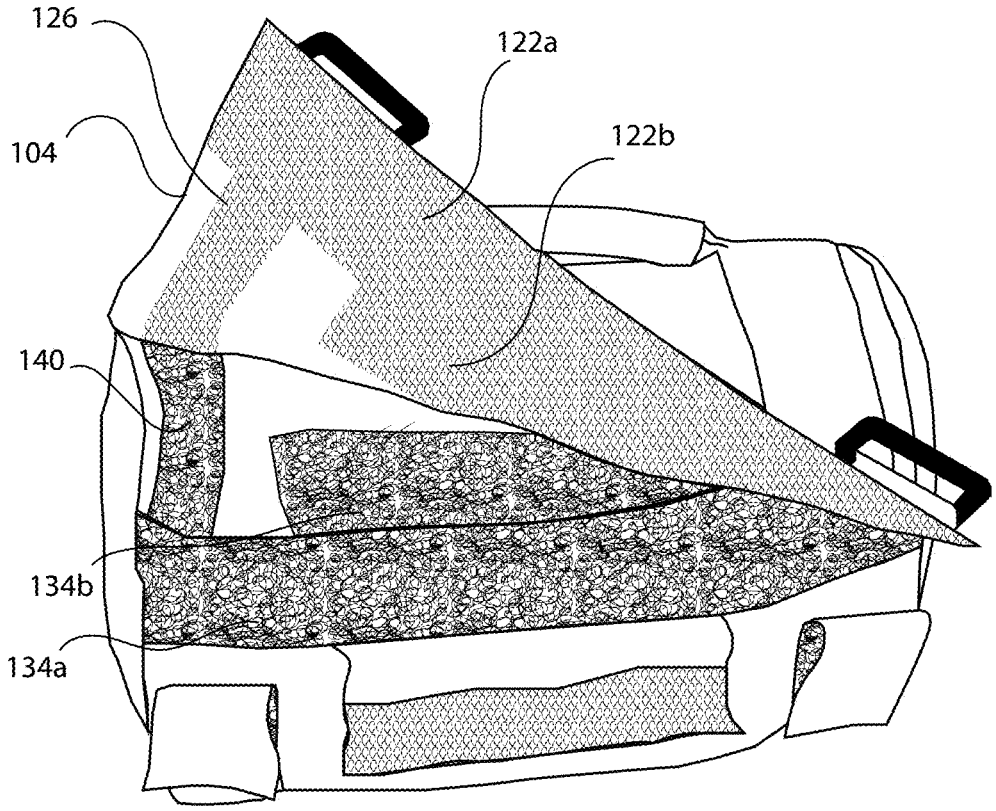
FIG. 5 is a side view of the main bag as it is being closed using the hook and loop fasteners.

After the inside flaps 128 are secured, FIG. 5 depicts how the main bag 104 is completely enclosed using the hooks 122*a*, 122*b* with the loops, 134*a* and 134*b*. The radial hook 126 and loop 140 are also depicted as being fastened where all three sides (midsection and pair of radial ends) of the main bag 104 are completely fastened.

Figure 6:
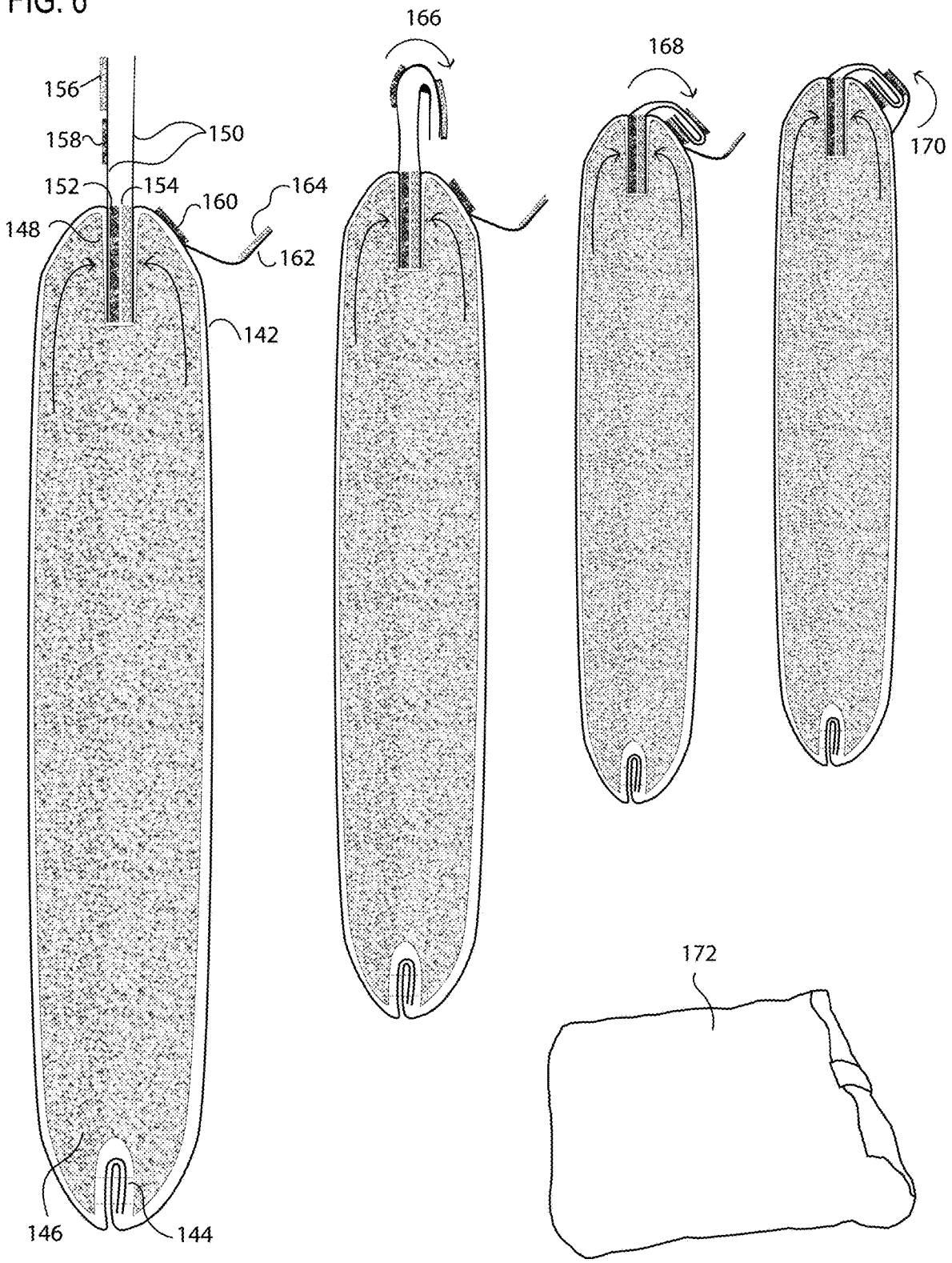
FIG. 6 is a cross-sectional view and a planar view of the inner lining illustrating how granular medium can be filled into the inner lining and secured in place with the hook and loop fasteners.

In this embodiment, the inner lining 172 is depicted through its cross-sectional and planar views in FIG. 6. The inner lining 172 is the main compartment where the weight is inserted by the user. The inner lining 172 can be shaped to be a cylindrical pouch, a rectangular pouch or a square pouch so long as it firmly fits in the main bag 104. The weight inserted within the inner lining 172 can be a granular medium 146 such as sand, rice or some other type of fine or coarse material. Moreover, the granular medium 146 can be mixed in with other substances such as a heaver or denser substrate. The purpose of the inner lining 172 is to contain the weight in a secured state so that the contents do not spill out of the main bag 104. The inner lining 172 is projected to be made of the same material that the main bag 104 is made of, however, it is not limited to those materials. The contents of the inner lining 172 are secured into place by the sewn walls of the inner lining 172 and a series of hook and loop fasteners. For example, in one embodiment, the inner lining 172 has funnel walls 150 that extend from the inner lining 172 and further extend into the inner lining 172 creating lips 148. The set of lips 148 have sewn or incorporated on their inside walls a set of hook 152 and loop 154 fasteners such that when the hook 152 and loop 154 sections meet one another, they create a closing liner. When the user fills the inner lining 172 with the desired content such as a granular medium 146 guided by the funnel walls 150, the hook 152 and loop 154 fastener can then be closed. Because the granular medium 146 provides negative pressure unto the lips 148, the hook 152 and loop 154 fasteners are solidly locked into place. In fact, the more pressure that is applied unto the lips, 148 (indicated by the arrows), the better the hook 152 and loop 154 fastener performs. So, if a user drops the modular weight 100, which contains the inner lining 172, the hook 152 and loop 154 would be engaged further due to this negative pressure applied to the lips 148 virtually guaranteeing that the contents do not spill out from the inner lining 172.

The inner lining 172 has the extending funnel walls 150 with a set of hook 158 and loop 156 sections sewn unto it. The funnel walls 150 are then folded over as indicated by the operations 166 and 168 where the loop 156 meets its designated hook 160 to create a fastener. Likewise, the hook 158 is now fastened, by operation 170, in place using a lining flap 162 which also has a loop 164 sewn on the inside end of the lining flap 162. These series of folds and fastening of the hook and loops guarantees that the excess end of the inner lining 172 is secured in place and the contents within it are guaranteed not to spill out. Moreover, the other ends 144 of the inner lining 172 is sewn together shut so that no material can pass through. Because the inner lining 172 just needs one side to be accessible for filling in at the outset, only the funnel walls 150 can allow for such an access. The other ends 144 are sewn shut throughout the three sides of the inner lining 172. Because this figure illustrates a cross-sectional view, it depicts one end 144. The other two sides are all connected with this end 144 which would otherwise be shown as a connected whole depicting a "U" shape. Nonetheless, the ends 144 that shows the stitching which runs on three sides of the inner lining 172 is then reversed inside out before the contents are filled. In some embodiments, it is projected that the inner lining 172 is only filled with a granular medium 146 and another filled packet (discussed below) can be inserted along with the inner lining 172 into the main bag 104 to increase the weight. In another embodiment, the filled packet is inserted into the inner lining 172 and mixed in with the granular medium 146.

Figure 7:
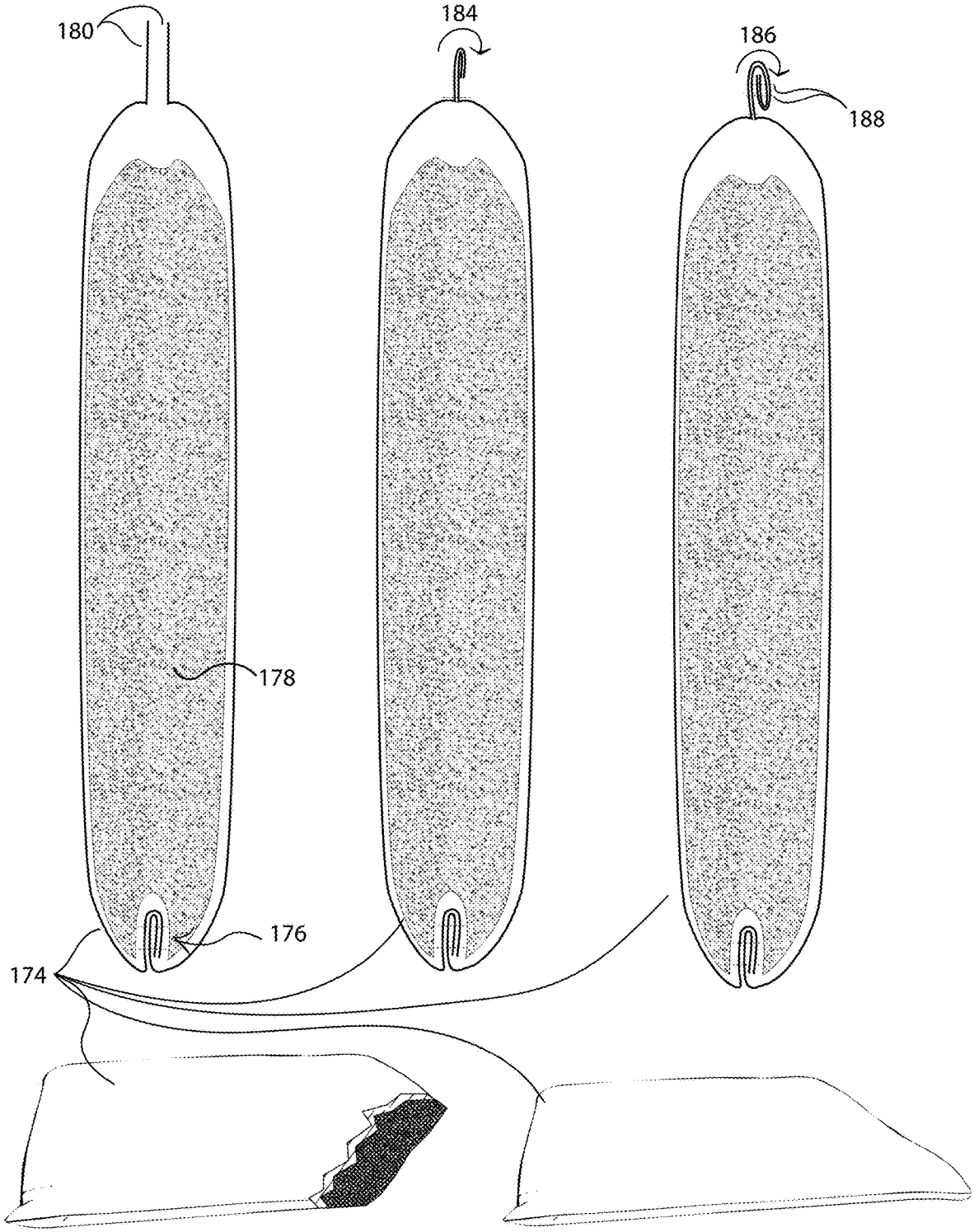
FIG. 7 shows a cross-sectional view and a planar view of the prepackaged packets of the heavier and denser metallic substrate that can be used in conjunction with the inner lining to add weight.

The funnel walls 150 can be varied in size to allow for different materials to pass through and into the inner lining 172. It is contemplated that large sized metal beads, pellets, shavings, bearings or even bars can be inserted into the inner lining 172. In some embodiments, these heavier and denser substrates can be inserted into the inner lining 172 in packaged packets. In FIG. 7, an example of a packet 174 is shown in its cross-sectional and planar views. The packet 174 is already packed with a heavier and denser substrate 178 such as metal beads, bearings, shavings or bars. This substrate 178 can be inserted using the funnel 180 and then the funnel 180 can be folded down in operations 184 and 186 and stitched or sewn at various locations 188. The packet also has the other ends 176 folded and stitched unto itself and the overall packet 174 can be reversed inside out, much like the inner lining 172. Once the packet 174 is stitched on its three sides 176, the whole bag is turned inside out and then the contents filled. The reversing of the stitching provides further security of the packet 174 as well as making it easier to insert and take it out of the inner lining 172 without the packet 174 snagging other materials. After the packet 174 is filled, the other end can be folded down and stitched 188 to guarantee that the contents do not spill out. As stated before, the packet 174 can either be inserted into the inner lining 172 or placed alongside it when inserting it into the main bag 104.

Figure 8:
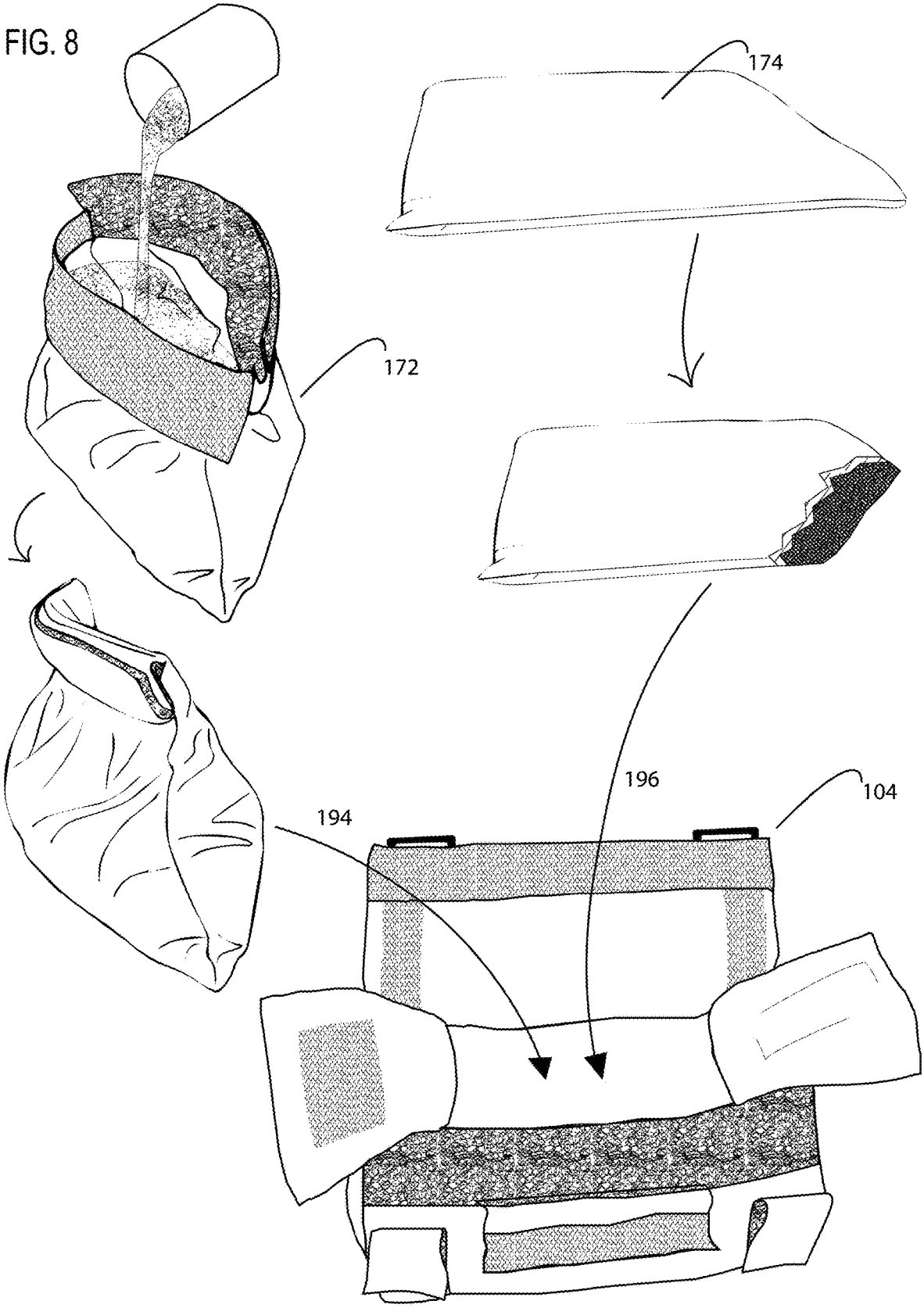
FIG. 8 is an application view of how an inner lining can be filled with a granular medium and combined with a prepackaged packet as both of those parts are inserted into the main bag.

In FIG. 8, the embodiment is depicted as the user is inserting the inner lining 172 along with the packet 174 into the main bag 104. The user fills the inner lining 172 with the desired amount of granular medium 146 and pairs it with the desired packet 174 that he wishes to insert into the main bag 104 with operations 194 and 196. It is contemplated that the user can vary the proportion of the granular medium 146 with the prepackaged packet 174 to make the modular weight 100 heavier or lighter based on the exercise routine. As stated before, the packet 174 can instead be inserted into the inner lining 172 and then with the series of hooks and loops the inner lining 172 can be fastened to secure the contents. Then the combination of the packet 174 and inner lining 172 can be inserted into the main bag 104. The varying of the proportions of the granular medium 146 and the heavier denser metal substrate 178 allows a more flexible exercise equipment. These proportions are shown for example in Table 1, however, different combinations are also contemplated as these numbers are for illustrative purposes only.

TABLE 1

| Total weight (lbs) | Granular Medium (lbs) | Steel Shots (lbs) | Coated Lead Shot (lbs) |
|---|---|---|---|
| 10 | 10 | 0 | 0 |
| 15 | 10 | 5 | 0 |
| 20 | 10 | 10 | 0 |
| 25 | 5 | 20 | 0 |
| 30 | 5 | 25 | 0 |
| 35 | 5 | 30 | 0 |
| 40 | 0 | 40 | 0 |
| 45 | 0 | 10 | 35 |
| 50 | 0 | 10 | 40 |
| 55 | 0 | 0 | 55 |

The heavier and denser substrate 178 contained in the packet 174 can be placed in the inner most part of the inner lining 172 or on top of the inner lining 172 so that when the main bag 104 is dropped unto the floor or unto someone's limb, the force is distributed evenly across the granular medium 146 and the energy is absorbed in uniform fashion. This is how the level of noise is cut down and the impact of the drop does not hurt the user or bystander if it lands on their limbs. Packing the heaver and denser substrate 178 (contained within the packet 174) closer to the middle of the main bag 104 or at the top allows the bottom side, where the granular medium 146 (filled within the inner lining 172) is likely located, to take the brunt of the impact. Furthermore, because the main bag 104 employs various flaps and hook and loop fasteners throughout the modular weight 100, the contents will not shift around and thus the granular medium 146 is likely to stay in place.

Figure 9:
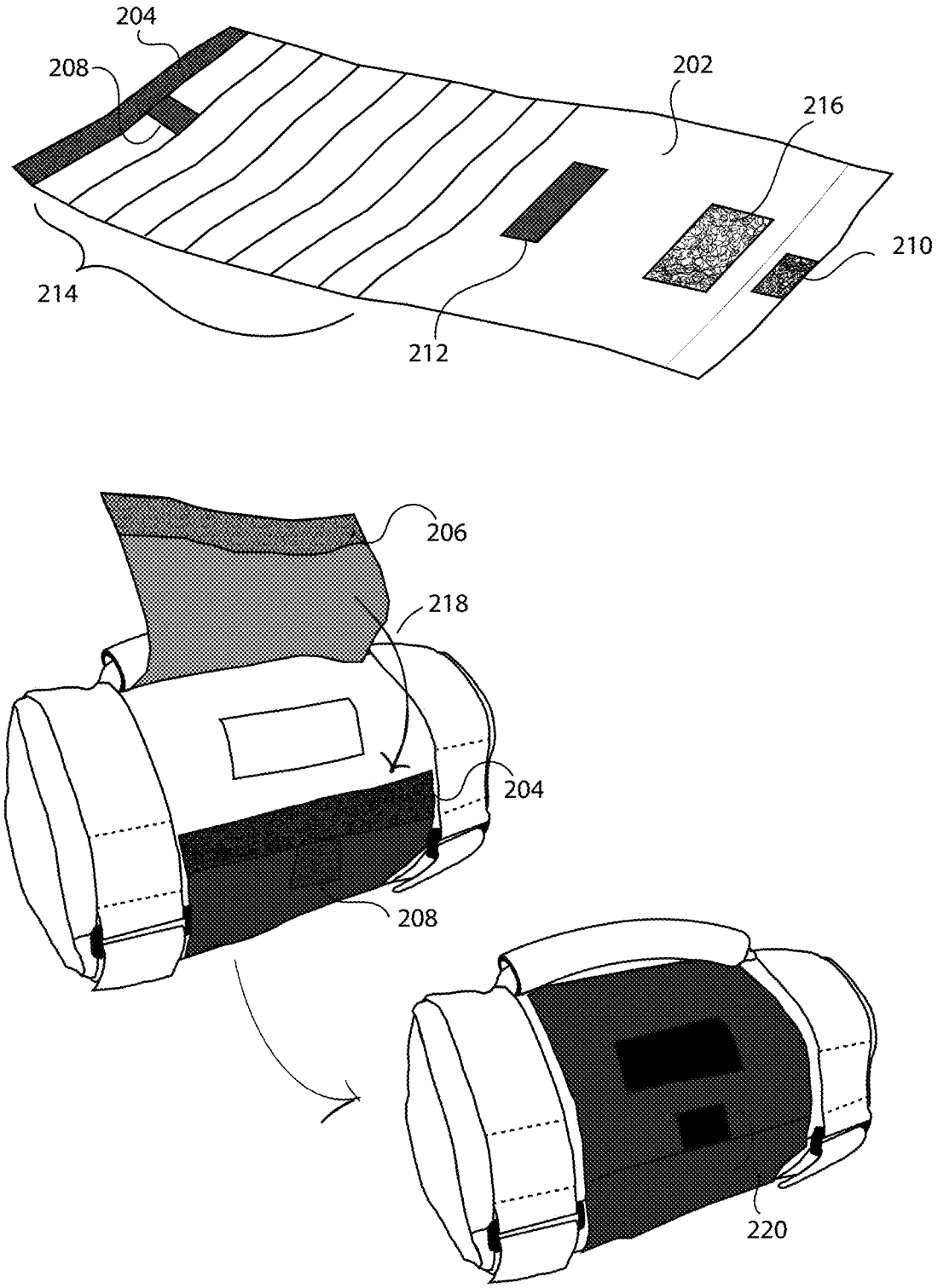
FIG. 9 is an application view of the add-on weight being installed unto the main bag.

In FIG. 9. the add-on weight 202 is shown in various stages of being installed unto the main bag 104. The add-on weight 202 is a flexible pouch filled with some granular substance in the linear pockets 214. The ribbed linear pockets 214 are spaced apart and stitched unto the fabric which secures the contents in place. The add-on weight 202 can be made of the same material that the main bag 104 is made of. The add-on weight 202 also has on one end a hook strip 204 which is met at its companion loop strip 206 when the add-on eight 202 is wrapped around the main bag 104. The add-on weight 202 is draped underneath the single handle 110, wrapped around the main bag 104 and secured in place using the hook strip 204 and loop strip 206 as shown by operation 218. Once this is done, the attachment flap which has a hook section 208 sewn unto it is closed up and fastened in place using the loop section 210 in operation 220. This is to further make sure that if the add-on weight 202 turns or shifts around, the two ends will not come undone. Furthermore, in some embodiments, the add-on weight 202 can have another hook 212 section sewn unto it such that the add-on weight 202 can be collapsed or wrapped around itself and secured using the hook 212 and loop strip 206 for storage purposes. Moreover, either a hook or loop section 216 can be stitched unto the add-on weight 202 and then used as a means to secure a patch of loop or hook fabric, respectively, which can have the gym insignia or weight information of the add-on weights 202. As a variation, the hook or loop 216 section can be a transparent window that enables the user to see the underside of the add-on weight 202 and discern from the main bag 104 what the gym insignia is or its weight information.

The add-on weights 202 are used as a temporary means of increasing the overall weight of the modular weights 100. The incremental weight increase provided by the add-on weights 202 is sometimes what the user needs to add as part of their exercise routine, rather than switching over to another prefilled modular weight 100. Usually, these incremental weight increases can be in the amount of 2.5 lbs, however, the add-on weight 202 can have any weight increment desired by the user.

Figure 10:
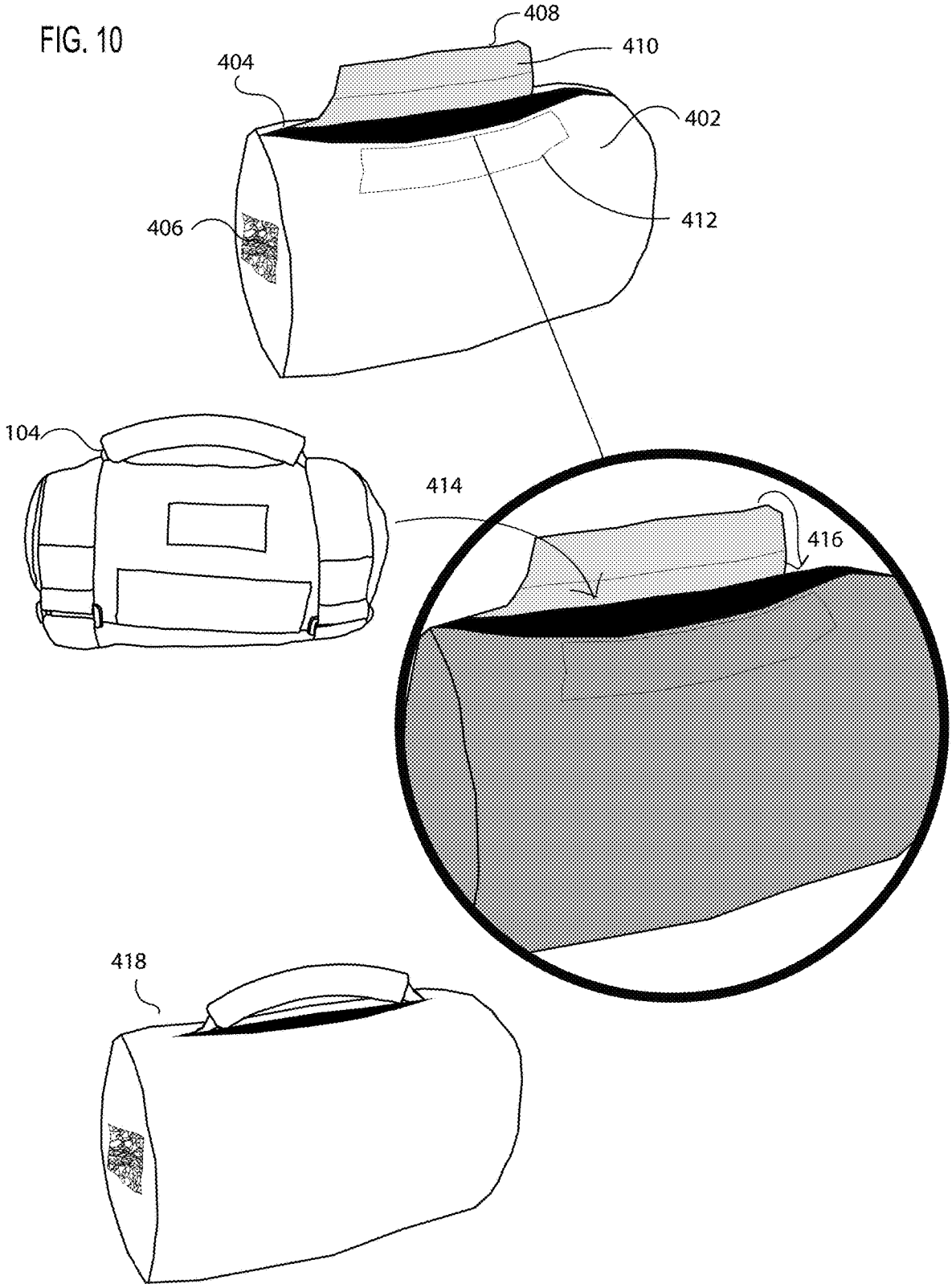
FIG. 10 is an application view of how the main bag is secured inside of the shell using the hook and loop fasteners.

In FIG. 10, the soft shell 402 is depicted inserting over the main bag 104. The soft shell 402 is intended to cover the main bag 104 and provide some padding when the user exercises with the modular weights 100. The soft shell 402 can be made of some flexible material such as rubber, foam or neoprene. The soft shell has an opening 404 large enough to stretch and fit the main bag 104 into it as shown in operation 414. The soft shell 402 has a closing flap 408 with a hook strip 410 incorporated thereon (outer or inner surface) which can be used to wrap underneath the single handle 110, as shown in operation 416, and fastened unto the loop strip 412. The loop strip 412 can be incorporated unto the outer surface of the soft shell 402 or in the inner surface of the soft shell 402 in the vicinity of the opening 404. The soft shell 402 also has a hook or loop section 406 where either the gym insignia or the weight information can be attached. Alternatively, the hook or loop section 406 can be a transparent window where the gym insignia or weight information can be discerned by the user. It is contemplated that the soft shell 402 can be in various colors and print patterns to suit the gym or the user's needs. Furthermore, the soft shell 402 can come in an enlarged size in order to accommodate fitting of the soft shell 402 unto two modular weights 100 as discussed below.

Figure 11A:
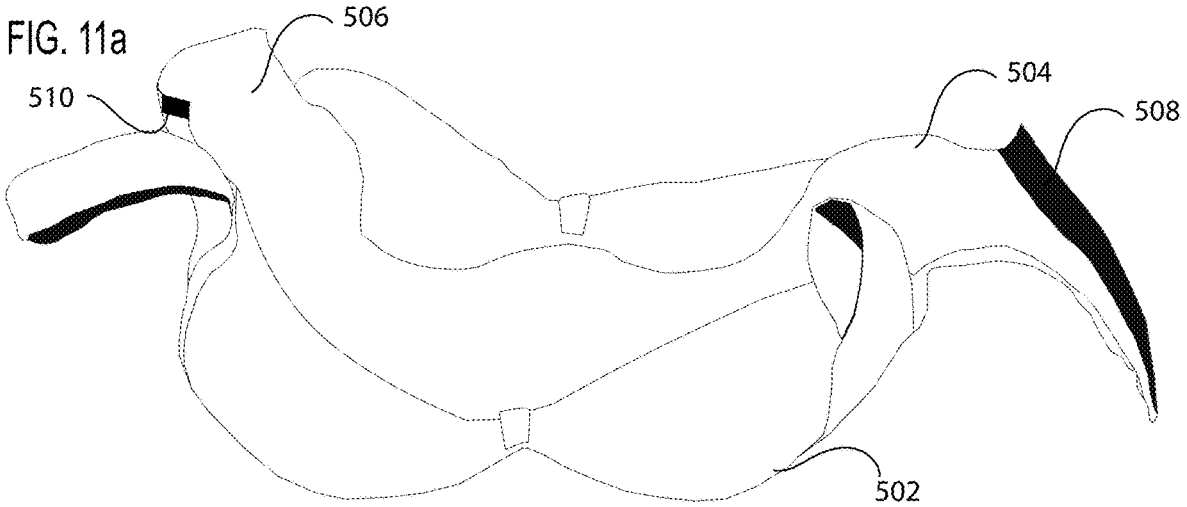
FIGS. 11*a*-11*b* is an application view showing how the sleeve capsule is used to insert two modular weights inside them to significantly increase the weight of the exercise weight.
Figure 11B:
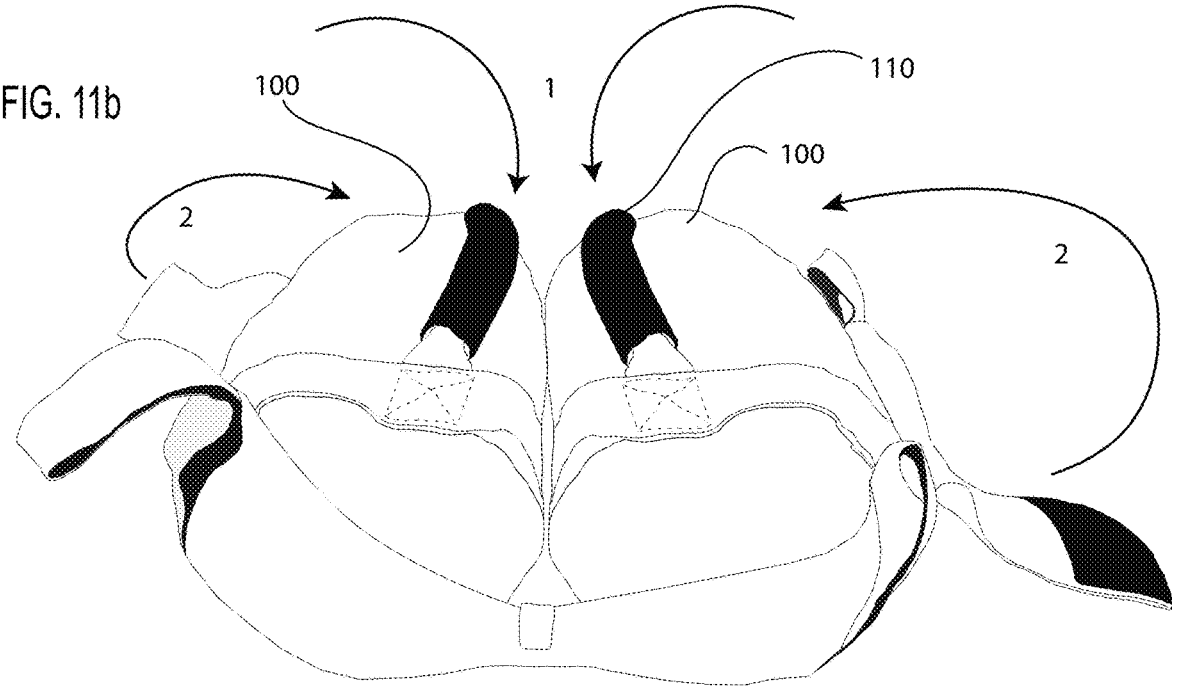
Figure 12A:
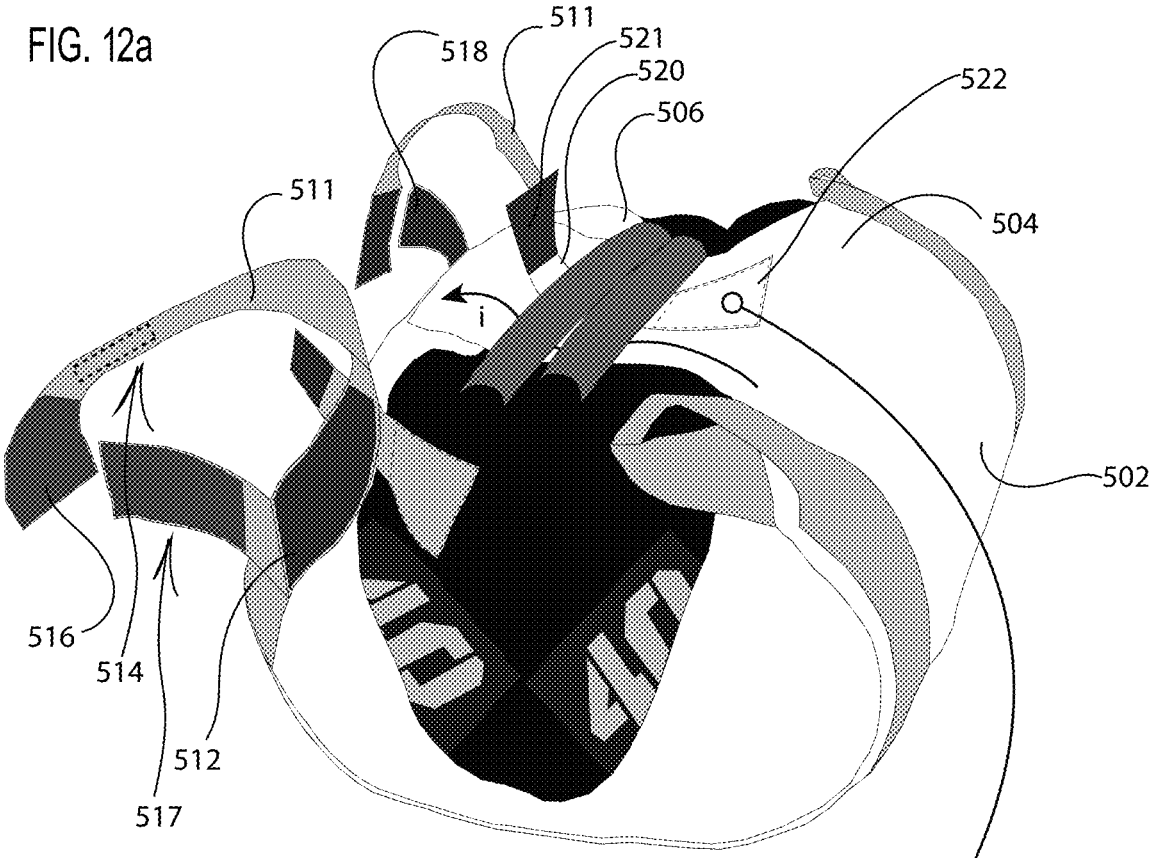
FIGS. 12*a*-12*f* is an application view showing how the two modular weights are secured in place with use of a series of hook and loop fasteners on the sleeve capsule.
Figure 12B:
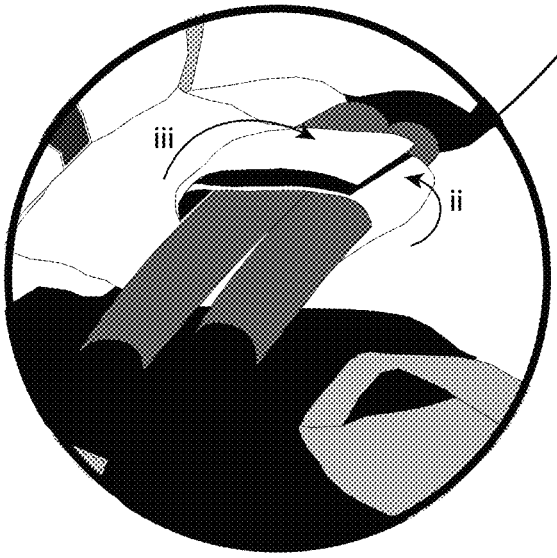
Figures 12C, 12D, 12E, 12F:
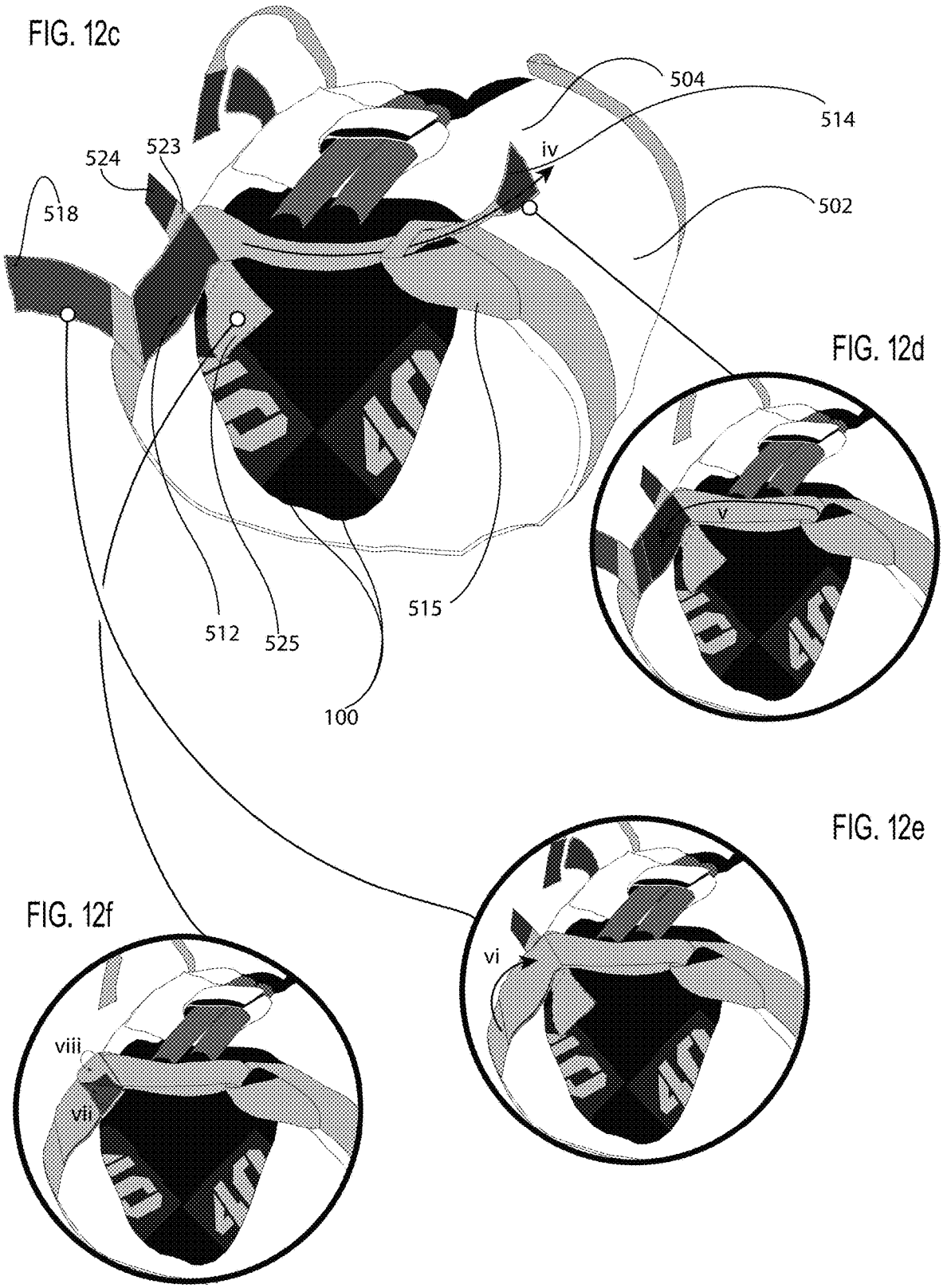

In FIGS. 11*a*-11*b*, the modular weights 100 are depicted where a sleeve capsule 502 surrounds two modular weights 100 in order to significantly increase the weights for a particular exercise. The sleeve capsule 502 is made of similar material that the main bag 104 is made of but has a wider profile in order for two modular weights 100 to fit into it. At first, the user inserts one modular weight 100 into the sleeve capsule 502 on the longer, non-radial side. Then the second modular weight 100 is inserted right next to the other modular weight 100 with both of their single handles 110 being exposed on the top, right next to one another. This operation is indicated by arrows 1 and 2 when the modular weights 100 are inserted into the sleeve capsule 502 and then the side flaps 504 and 506 are wrapped around both modular weights 100. The sleeve capsule 502 has a hook 508 section and a loop 510 section incorporated at the ends of the flaps 504 and 506, respectively.

In FIGS. 12*a*-12*f*, the sleeve capsule 502 is closed using a series of extension belts. In all, two extension belts are used. The extension belts 511 that are structurally identical are incorporated at the opening of the sleeve capsule 502 on either end and near the flap 506. These extension belts 511 each have their inside surface stitched with a hook 512 section and a loop 514 section, somewhat spaced apart. Approximately one to two inches of a hook 512 section is followed by a one to two-inch loop 514 section, which is stitched unto the extension belts 511. In between the hook 512 section and the loop 514 section, there can be material of the extension belt 511 or the hook 512 or loop 514 can run the length of the extension belt 511 one after the other. The hook 512 and loop 514 sections facing up are ran through an eyelet 515 sewn unto the opposite end of the sleeve capsule 502 near flap 504, as shown by operation iv. The user then pulls the extension belts 511 tightly through the eyelets 515 so the sleeve capsule 502 further hugs the modular weights 100 and cinches it down tight. Once the extension belts 511 are tightly pulled where no slack remains, the hook 512 and loop 514 sections are closed on one another, fastening them together as shown in operation v. Once the hook 512 and loop 514 section are fastened together, the extension belt 511 outside surface is exposed to the user. About a two-inch section of the extension belt 511 is visible at that point which also has a hook section 516 sewn unto it. On the extension belt 511 towards the end facing the flap 506, a security cover 517 is sewn unto the sleeve capsule 502 where the extension belt 511 terminates. The inside part of the security cover 517 is also stitched with a loop section 518. The hook section 516 and loop section 518 are then closed together, as shown in operation vi, to completely fasten the extension belts 511, ensuring that any impact will not let the extension belts 511 come undone. As a redundancy measure, two horizontal flaps 523 have complementing hook 524 and loop 525 sewn unto the horizontal flaps 523. The user can bring the hook 524 and loop 525 sections together and close it shut as shown in operations vii and viii.

At this point, both extension belts 511 are completely cinched down and secured in place using the sets of hook and loops as described. However, the midsection where the flap 506 and flap 504 meet for the hook 510 and loop 508 to fasten have a two handle flaps 520 that need to be secured. These handle flaps 520 have a hook 521 and loop 522 sections sewn unto them in order to fasten them together. Either handle flap 520 can have the hook 521 or loop 522 on either in the inside or outside surface of the handle flap 520 so long as the opposite end is structured so that the handle flaps 520 meet and fasten together. Once the handle flaps 520 wrap around the two single handles 110 of each modular weight 100, as shown in operations ii and iii, the hook 521 and loop 522 are fastened together to keep the single handles 110 together.

Figure 13A:
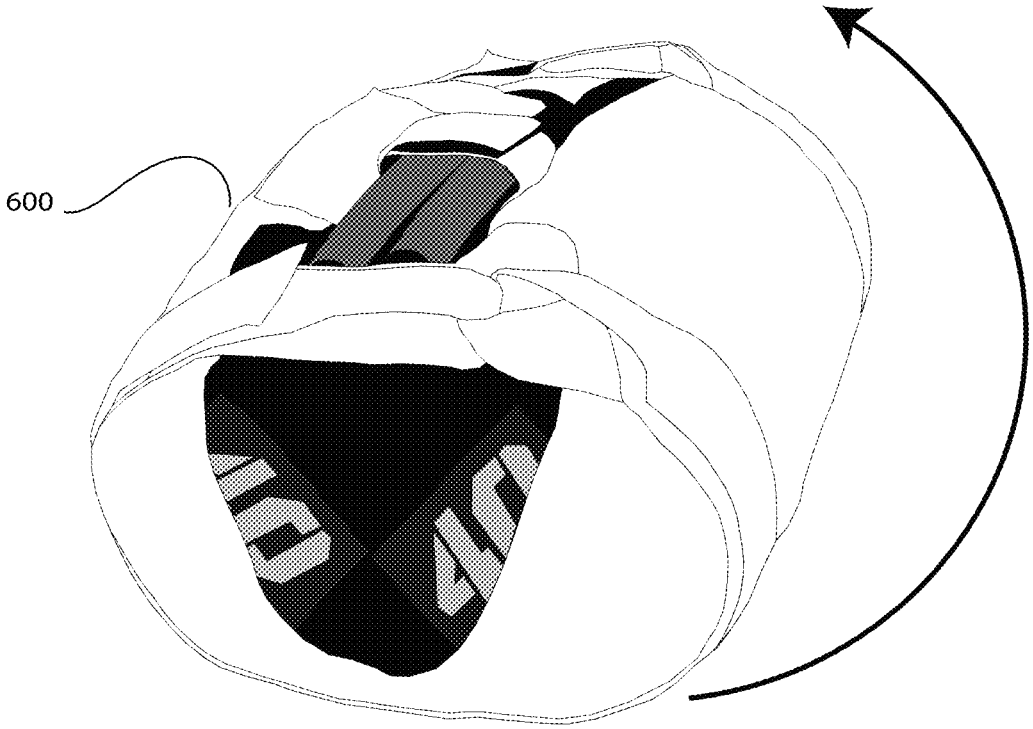
FIGS. 13*a*-13*b* shows a finalized view of a bigger modular weight apparatus, with a single handle, that is packed with the lighted modular weights.
Figure 13B:
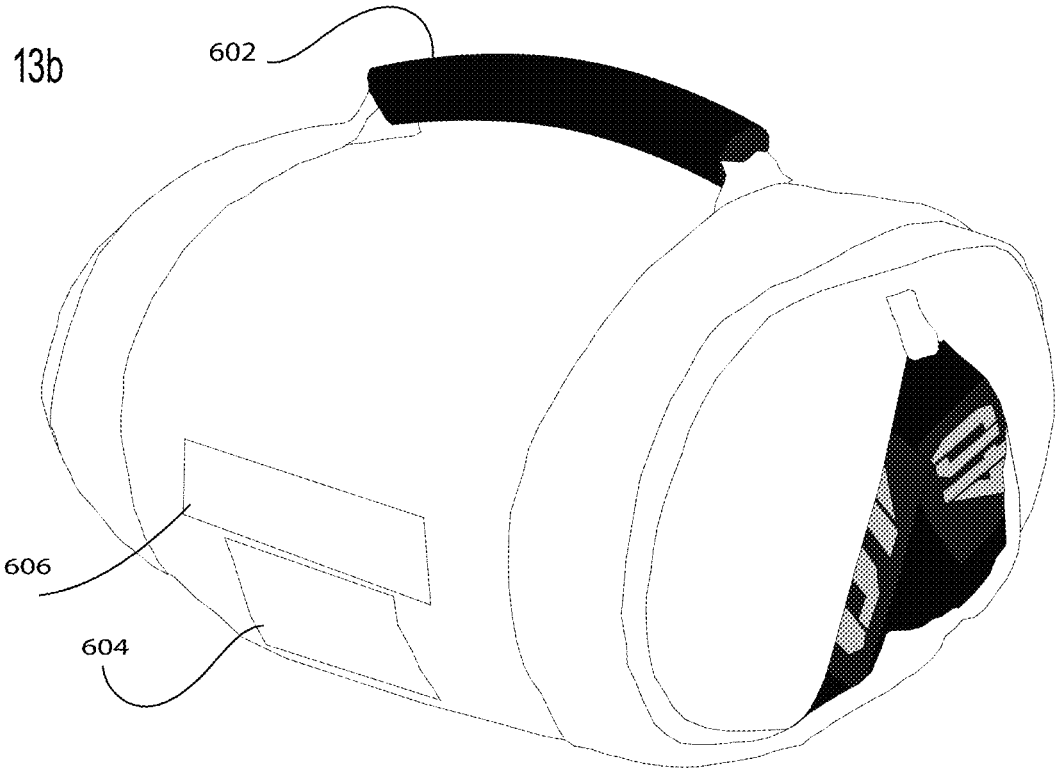

In FIGS. 13*a*-13*b*, the modular weights 100 are depicted to show the two modular weights 100 inserted into the sleeve capsule 502. In this rendition, two 40 lb modular weights 100 are conjoined to makeup a large modular weight 600. The modular weight 600 is then turned over to expose a unitary handle 602. The unitary handle 602 is made of the same material that the single handle 110 is made of. The unitary handle 602 is constructed so to keep the same type of low profile as any individual modular weight 100 so that the kinematics of the exercise routine are not affected. As indicated above, a larger sized soft shell 402 can be used to cover the large modular weight 600. Moreover, the side of the large modular weight 600 has a section sewn with a hook or loop patch 604 allowing the user to install insignia of the gym and/or information regarding the weight of the large modular weight 600. Furthermore, another hook or loop section 606 is incorporated to allow the user to fold up the sleeve capsule 502 and store it once it is no longer used.

This detailed description has been provided only for illustrative purposes. It is recognized that other embodiments maybe articulated without departing from the objects and scope of the present invention. Any such modifications and variations are meant to be within the scope of the invention as contained within the following claims.

What is claimed is:

1. A modular handheld weight training apparatus and closure system comprising:

a main cylindrical bag constructed from a pliable material and accessible from a top section;

a single handle located on the top section that runs at a midsection of the main cylindrical bag;

wherein the main cylindrical bag opens partially from the top section for placement of an inner lining and/or a prepackaged packet;

a series of fasteners, for securing contents within the main cylindrical bag, incorporated into the main cylindrical bag;

wherein the inner lining and/or the prepackaged packet is cinched into place and secured initially using two internal side flaps integrated with fasteners;

wherein the inner lining can be filled with a granular medium;

wherein the prepackaged packet can be filled in with a heavier and denser substrate relative to the granular medium;

wherein the inner lining and/or the prepackaged packet are further secured by reinforcement bands sewn unto both ends of the main cylindrical bag; and wherein the reinforcement bands are cinched down using fasteners.

2. The modular handheld weight training apparatus and closure system of claim 1, further comprising:

a soft-shell cover that is inserted over the main cylindrical bag; and wherein the soft-shell cover is secured in place using integrated fasteners.

3. The modular handheld weight training apparatus and closure system of claim 2, further comprising a designated area on the soft-shell cover for incorporating a fastening fabric that displays information.

4. The modular handheld weight training apparatus and closure system of claim 1, further comprising:

a sleeve capsule constructed from a pliable material and accessible from a top section;

wherein the sleeve capsule is accessible from its top section where two main cylindrical bags can be stored side-by-side;

wherein the sleeve capsule incorporates cinching belts with fasteners to secure the top section of the sleeve capsule;

wherein the sleeve capsule incorporates wrap around flaps with fasteners to secure the single handle of each main cylindrical bag and contents of the sleeve capsule; and wherein the underside of the sleeve capsule incorporates a low-profile handle that runs at its midsection.

5. The modular handheld weight training apparatus and closure system of claim 4, further comprising a designated area on the sleeve capsule for incorporating a fastening fabric that displays information.

6. The modular handheld weight training apparatus and closure system of claim 1, wherein:

the inner lining is stitched shut on three of its sides running continuously;

the inner lining is turned inside out reversing the stitching so that it no longer is visible to the user;

the inner lining incorporates a set of funnel walls that extend into the inner lining creating two lips;

the two lips are integrated with complementary fasteners that when closed shut, keep the funnel closed from the outside environment;

the lips remain shut as the granular medium provides negative pressure unto the set of funnel walls extending into the inner lining; and the set of funnel walls extending out of the inner lining incorporates a set of complementary fasteners that fold inwards and fasten unto an external part of the inner lining.

7. The modular handheld weight training apparatus and closure system of claim 6, further comprising a designated area on the main cylindrical bag for incorporating a fastening fabric that displays information.

8. The modular handheld weight training apparatus and closure system of claim 1, further comprising:

an add-on weight attachment with pockets containing granular medium; and wherein the add-on weight attachment integrates a set of fasteners for securing it unto the main cylindrical bag as the add-on weight is wrapped around the midsection of the main cylindrical bag.

9. The modular handheld weight training apparatus and closure system of claim 8, further comprising a designated area on the add-on weight attachment for incorporating a fastening fabric that displays information.

10. A modular handheld weight training apparatus and closure system, comprising:

a main cylindrical bag constructed from a pliable material and accessible from a top section;

wherein the main cylindrical bag incorporates a single handle located on the top section that runs at its midsection;

wherein the main cylindrical bag opens partially from the top section for placement of an inner lining and/or a prepackaged packet;

wherein the main cylindrical bag integrates a series of fasteners for securing contents within the main cylindrical bag;

wherein the inner lining and/or the prepackaged packet is cinched into place and secured initially using two internal side flaps integrated with fasteners;

wherein the inner lining can be filled with a granular medium;

wherein the prepackaged packet can be filled in with a heavier and denser substrate relative to the granular medium;

wherein the inner lining and/or the prepackaged packet are further secured by reinforcement bands sewn unto both ends of the main cylindrical bag; and wherein the reinforcement bands are cinched down using fasteners.

11. The modular handheld weight training apparatus and closure system of claim 10, wherein:

the inner lining is stitched shut on three of its sides running continuously;

the inner lining is turned inside out reversing the stitching so that it no longer is visible to the user;

the inner lining incorporates a set of funnel walls that extend into the inner lining creating two lips;

the two lips are integrated with complementary fasteners that when closed shut, keep the funnel closed from the outside environment;

the lips remain shut as the granular medium provides negative pressure unto the set of funnel walls extending into the inner lining; and the set of funnel walls extending out of the inner lining incorporates a set of complementary fasteners that fold inwards and fasten unto an external part of the inner lining.

12. The modular handheld weight training apparatus and closure system of claim 11, further comprising:

a sleeve capsule constructed from a pliable material and accessible from a top section;

wherein the sleeve capsule is accessible from its top section where two main cylindrical bags can be stored side-by-side;

wherein the sleeve capsule incorporates cinching belts with fasteners to secure the top section of the sleeve capsule;

wherein the sleeve capsule incorporates wrap around flaps with fasteners to secure the single handle of each main cylindrical bag and contents of the sleeve capsule; and wherein the underside of the sleeve capsule incorporates a low-profile handle that runs at its midsection.

13. The modular handheld weight training apparatus and closure system of claim 12, further comprising:

a soft-shell cover that is inserted over the sleeve capsule; and wherein the soft-shell cover is secured in place using integrated fasteners.

14. The modular handheld weight training apparatus and closure system of claim 13, further comprising a designated area on the soft-shell cover for incorporating a fastening fabric that displays information.

15. The modular handheld weight training apparatus and closure system of claim 12, further comprising a designated area on the sleeve capsule for incorporating a fastening fabric that displays information.

* * * * *